US011721469B2

(12) United States Patent
Otani et al.

(10) Patent No.: US 11,721,469 B2
(45) Date of Patent: Aug. 8, 2023

(54) ELECTRONIC COMPONENT AND PRODUCTION METHOD THEREOF

(71) Applicant: Murata Manufacturing Co., Ltd., Kyoto-fu (JP)

(72) Inventors: Shinji Otani, Nagaokakyo (JP); Hiroki Imaeda, Nagaokakyo (JP); Namiko Sasajima, Nagaokakyo (JP); Tomohiro Sunaga, Nagaokakyo (JP); Masami Okado, Nagaokakyo (JP); Yoshimasa Yoshioka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 295 days.

(21) Appl. No.: 16/995,176

(22) Filed: Aug. 17, 2020

(65) Prior Publication Data

US 2021/0065952 A1 Mar. 4, 2021

(30) Foreign Application Priority Data

Sep. 3, 2019 (JP) ..... 2019-160555

(51) Int. Cl.

| | |
|---|---|
| ***H01F 17/04*** | (2006.01) |
| ***H01F 27/255*** | (2006.01) |
| ***H01F 41/04*** | (2006.01) |
| ***H01F 1/14*** | (2006.01) |
| ***H01F 1/06*** | (2006.01) |
| ***H01F 1/26*** | (2006.01) |
| ***H01F 27/29*** | (2006.01) |
| ***H01F 41/10*** | (2006.01) |
| *H01F 17/00* | (2006.01) |

(52) U.S. Cl.

CPC ..... *H01F 17/04* (2013.01); *H01F 1/06* (2013.01); *H01F 1/14* (2013.01); *H01F 1/26* (2013.01); *H01F 27/255* (2013.01); *H01F 27/292* (2013.01); *H01F 41/04* (2013.01); *H01F 41/046* (2013.01); *H01F 41/10* (2013.01); *H01F 17/0006* (2013.01); *H01F 2017/0066* (2013.01); *H01F 2017/048* (2013.01); *Y10T 428/32* (2015.01)

(58) Field of Classification Search

None

See application file for complete search history.

(56) References Cited

U.S. PATENT DOCUMENTS

| | | | | |
|---|---|---|---|---|
| 9,984,805 | B2 * | 5/2018 | Kudo | H01F 17/0013 |
| 10,340,072 | B2 * | 7/2019 | Kitajima | H01F 41/0206 |
| 11,488,760 | B2 * | 11/2022 | Muneuchi | H01F 1/20 |
| 11,508,507 | B2 * | 11/2022 | Okumura | H01F 5/003 |
| 2010/0052838 | A1 | 3/2010 | Matsuta et al. | |

(Continued)

FOREIGN PATENT DOCUMENTS

| | | |
|---|---|---|
| CN | 101667484 A | 3/2010 |
| CN | 104103420 A | 10/2014 |

(Continued)

*Primary Examiner* — Kevin M Bernatz

(74) *Attorney, Agent, or Firm* — Studebaker & Brackett PC

(57) ABSTRACT

An electronic component includes a composite body composed of a composite material of a resin and a magnetic metal powder and a metal film disposed on an outer surface of the composite body. The magnetic metal powder contains Fe. The metal film mainly contains Ni and is in contact with the resin and the magnetic metal powder.

20 Claims, 4 Drawing Sheets

(56) References Cited

U.S. PATENT DOCUMENTS

| | | | | |
|---|---|---|---|---|
| 2014/0293503 | A1 | 10/2014 | Sasabayashi et al. | |
| 2016/0035476 | A1* | 2/2016 | Mimura | H01F 41/046 336/199 |
| 2017/0169930 | A1* | 6/2017 | Kudo | H01F 17/0013 |

FOREIGN PATENT DOCUMENTS

| | | | |
|---|---|---|---|
| CN | 107818864 | A | 3/2018 |
| JP | 2013-225718 | A | 10/2013 |

* cited by examiner

ELECTRONIC COMPONENT AND PRODUCTION METHOD THEREOF

CROSS-REFERENCE TO RELATED APPLICATION

This application claims benefit of priority to Japanese Patent Application No. 2019-160555, filed Sep. 3, 2019, the entire content of which is incorporated herein by reference.

BACKGROUND

Technical Field

The present disclosure relates to an electronic component and a production method thereof.

Background Art

Hitherto, an electronic component disclosed in Japanese Unexamined Patent Application Publication No. 2013-225718 has been known. The electronic component includes a composite body (an upper core and a lower core) composed of a composite material of a resin and a magnetic metal powder and metal films (terminal electrodes) disposed on an outer surface of the composite body. The magnetic metal powder contains Fe.

SUMMARY

In such an electronic component of the related art as described above, Cu, which is highly conductive, is used for the metal films. The coefficient of linear expansion of the magnetic metal powder containing Fe is significantly different from that of a metal film containing Cu. Thus, the adhesion between the magnetic metal powder and the metal film may be decreased under thermal loading.

Accordingly, the present disclosure provides an electronic component having improved reliability of the adhesion between a magnetic metal powder and a metal film and a method for producing the electronic component.

According to preferred embodiments of the present disclosure, an electronic component includes a composite body composed of a composite material of a resin and a magnetic metal powder and a metal film disposed on an outer surface of the composite body. The magnetic metal powder contains Fe. The metal film mainly contains Ni and is in contact with the resin and the magnetic metal powder.

The phrase "the metal film mainly containing Ni" indicates that the metal film has a Ni content of about 80% or more by weight.

In this case, the magnetic metal powder contains Fe, and the metal film mainly contains Ni; thus, the coefficient of linear expansion of the metal film can be close to the coefficient of linear expansion of the magnetic metal powder, thereby suppressing a decrease in adhesion between the magnetic metal powder and the metal film under thermal loading. This can lead to improved reliability of the adhesion between the magnetic metal powder and the metal film.

In the electronic component according to preferred embodiments of the present disclosure, the metal film may be amorphous.

In this case, since the metal film is amorphous, the metal film can have a flat surface and a small thickness, compared with a metal film having a crystal structure.

In the electronic component according to preferred embodiments of the present disclosure, the metal film may further contain P.

In this case, since the metal film contains P, the metal film has improved corrosion resistance. Additionally, Ni starts to precipitate without a substitution reaction with Fe. This can lead to further improved adhesion between the magnetic metal powder and the metal film.

In the electronic component according to preferred embodiments of the present disclosure, the metal film may have a P content of about 1% or more by weight and about 13% or less by weight (i.e., from about 1% by weight to about 13% by weight).

In this case, since the metal film has a P content of about 1% or more by weight, the metal film can reliably have improved corrosion resistance and improved adhesion. Since the metal film has a P content of about 13% or less by weight, the formability of the metal film is improved.

In the electronic component according to preferred embodiments of the present disclosure, the metal film may further contain Fe.

In this case, since the metal film contains Fe, the coefficient of linear expansion of the metal film can be closer to that of the magnetic metal powder, thereby further suppressing a decrease in adhesion between the magnetic metal powder and the metal film under thermal loading.

The electronic component according to preferred embodiments of the present disclosure may further include an inductor line disposed in the composite body and extending parallel to the outer surface, a substantially columnar line extending from the inductor line in a direction perpendicular to the outer surface, penetrating through the composite body, and being exposed at the outer surface, and a solderable layer covering the metal film, in which the metal film may be in contact with the substantially columnar line, and the metal film and the solderable layer may be included in an external terminal.

In this case, it is possible to provide the electronic component having improved reliability of the adhesion between the composite body and the external terminal.

According to preferred embodiments of the present disclosure, a method for producing an electronic component includes forming a metal film on an outer surface of a composite body composed of a composite material of a resin and a magnetic metal powder by electroless plating treatment, in which the metal film mainly contains Ni, the magnetic metal powder contains Fe, and the metal film is deposited on the magnetic metal powder by autocatalytic reduction plating treatment and is in contact with the resin.

In this case, the magnetic metal powder contains Fe, and the metal film mainly contains Ni; thus, the coefficient of linear expansion of the metal film can be close to the coefficient of linear expansion of the magnetic metal powder, thereby suppressing a decrease in adhesion between the magnetic metal powder and the metal film under thermal loading. Additionally, Ni starts to precipitate without a substitution reaction with Fe. This can lead to further improved adhesion between the magnetic metal powder and the metal film. It is thus possible to produce the electronic component having improved reliability of adhesion between the magnetic metal powder and the metal film.

Other features, elements, characteristics and advantages of the present disclosure will become more apparent from the following detailed description of preferred embodiments of the present disclosure with reference to the attached drawings.

DETAILED DESCRIPTION

An electronic component according to an embodiment of the present disclosure will be described in detail below with reference to the attached drawings. The drawings include some schematic ones and may not reflect actual dimensions or proportions.

First Embodiment

Configuration

Figure 1A:
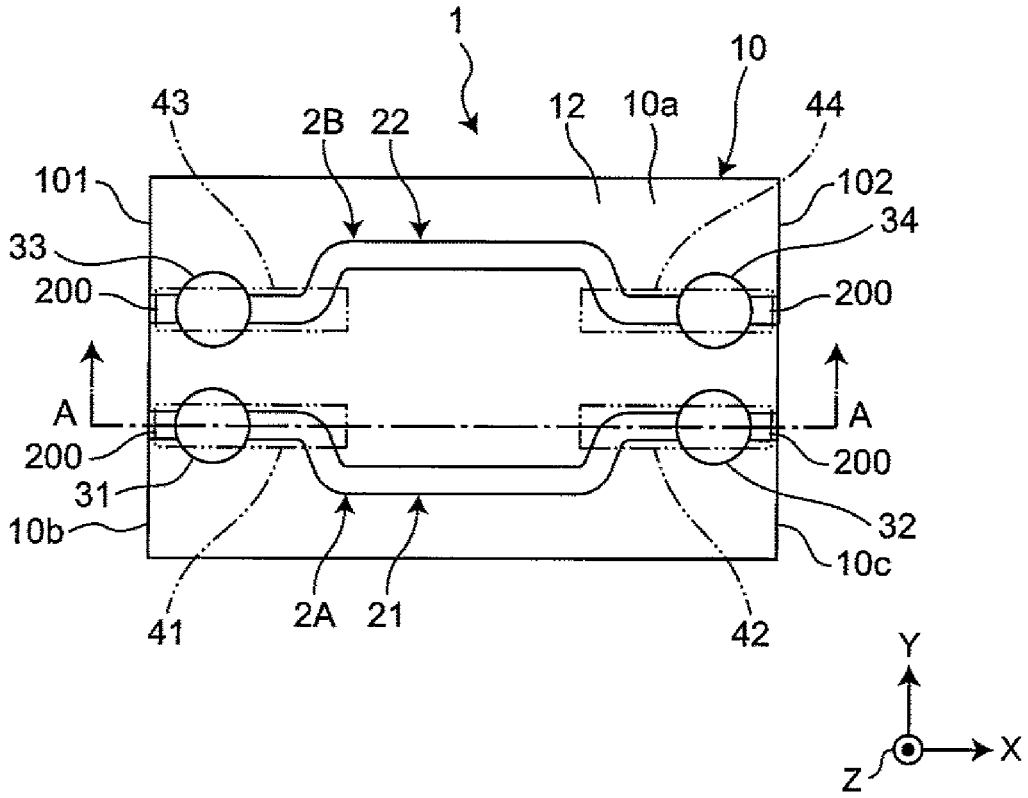
FIG. 1A is a perspective plan view of an inductor component as an electronic component according to a first embodiment.
Figure 1B:
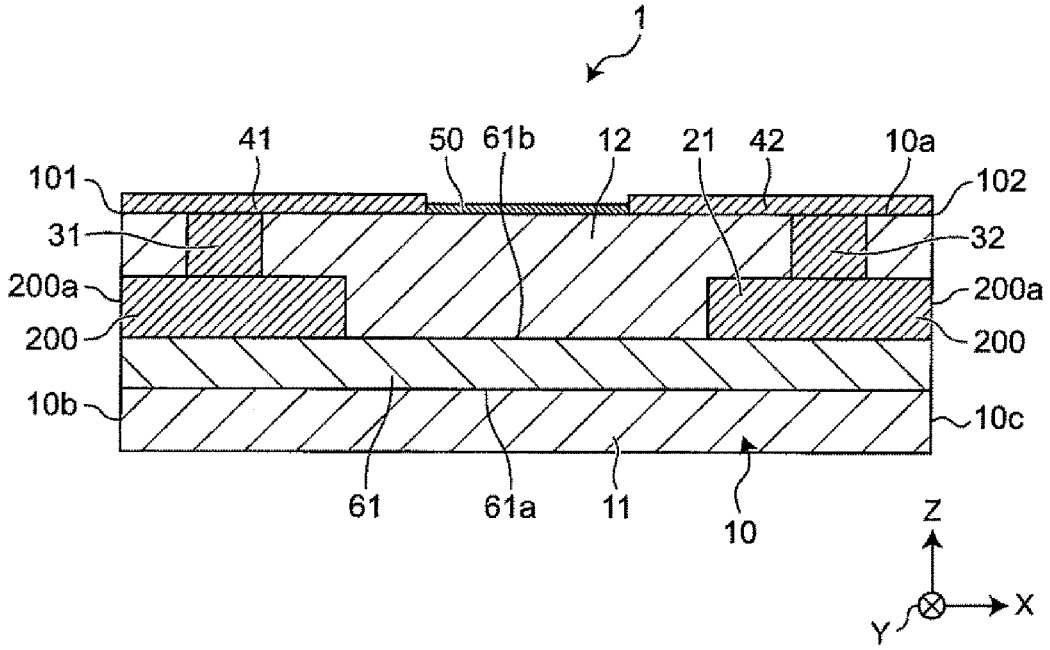
FIG. 1B is a cross-sectional view taken along line A-A of FIG. 1A.
Figure 2:
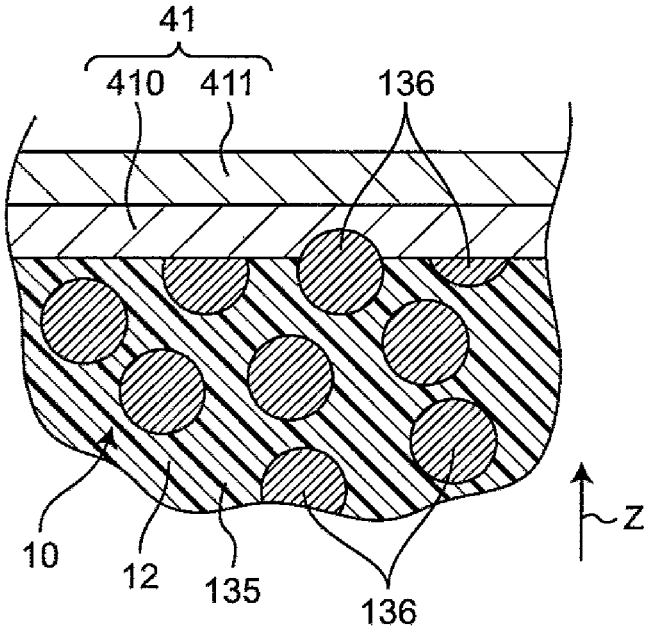
FIG. 2 is a partially enlarged view of FIG. 1B.

FIG. 1A is a perspective plan view of an electronic component according to a first embodiment. FIG. 1B is a cross-sectional view taken along line A-A of FIG. 1A. FIG. 2 is a partially enlarged view of FIG. 1B.

An example of the electronic component is an inductor component 1. The inductor component 1 is, for example, a surface-mount electronic component mounted on a circuit board installed in an electronic device such as a personal computer, a digital versatile disc (DVD) player, a digital camera, a television (TV) set, a cellular phone, or an automotive electronic system. The inductor component 1, however, may be an electronic component built in a substrate, instead of a surface-mount electronic component. The inductor component 1 is, for example, a substantially rectangular parallelepiped component as a whole. The shape of the inductor component 1 may be, but is not particularly limited to, a substantially cylindrical shape, a substantially polygonal columnar shape, a substantially truncated cone shape, or a substantially truncated polygonal pyramid shape.

As illustrated in FIGS. 1A and 1B, the inductor component 1 includes a base body 10 having insulating properties, a first inductor device 2A and a second inductor device 2B disposed in the base body 10, a first substantially columnar line 31, a second substantially columnar line 32, a third substantially columnar line 33, and a fourth substantially columnar line 34 that are buried in the base body 10, an end face of each of the first to fourth substantially columnar lines 31 to 34 being exposed at a substantially rectangular first main surface 10*a* of the base body 10, a first external terminal 41, a second external terminal 42, a third external terminal 43, and a fourth external terminal 44 that are disposed on the first main surface 10*a* of the base body 10, and an insulating film 50 disposed on the first main surface 10*a* of the base body 10. In the figure, a direction parallel to the thickness of the inductor component 1 is defined as a Z direction. The positive Z direction is defined as an upward direction. The negative Z direction is defined as a downward direction. In a plane perpendicular to the Z direction, a direction parallel to the direction of the length of the inductor component 1 is defined as an X direction, and a direction parallel to the direction of the width of the inductor component 1 is defined as a Y direction.

The base body 10 includes an insulating layer 61, a first magnetic layer 11 disposed on the lower surface 61*a* of the insulating layer 61, and a second magnetic layer 12 disposed on the upper surface 61*b* of the insulating layer 61. The first main surface 10*a* of the base body 10 corresponds to the upper surface of the second magnetic layer 12. The base body 10 has a three-layer structure including the insulating layer 61, the first magnetic layer 11, and the second magnetic layer 12. However, the base body 10 may have a single-layer structure consisting only of a magnetic layer, a two-layer structure consisting only of a magnetic layer and an insulating layer, or a four-or-more-layer structure consisting of multiple magnetic layers and an insulating layer.

The insulating layer 61 has insulating properties and is a layer having a substantially rectangular main surface. The insulating layer 61 has a thickness of, for example, about 10 μm or more and 100 μm or less (i.e., from about 10 μm to 100 μm). The insulating layer 61 is preferably, for example, an insulating resin layer composed of an epoxy-based resin or a polyimide-based resin containing no base material, such as glass cloth, from the viewpoint of reducing the profile. However, the insulating layer 61 may be a sintered layer composed of a magnetic material, such as NiZn- or MnZn-based ferrite, or a non-magnetic material, such as alumina or glass, or may be a resin substrate layer containing a base material, such as a glass-epoxy material. When the insulating layer 61 is a sintered layer, the insulating layer 61 has high strength and good flatness, thus improving the processability of a stacked material on the insulating layer 61. Additionally, when the insulating layer 61 is a sintered layer, the insulating layer 61 is preferably ground, in particular, is preferably ground from the undersurface on which no material is stacked, from the viewpoint of reducing the profile.

Each of the first magnetic layer 11 and the second magnetic layer 12 has high magnetic permeability, is a layer having a substantially rectangular main surface, and contains a resin 135 and a magnetic metal powder 136 in the resin 135. In other words, each of the first magnetic layer 11 and the second magnetic layer 12 is composed of a composite material of the resin 135 and the magnetic metal powder 136. The resin 135 is composed of an organic insulating material, such as epoxy-based resin, bismaleimide, a liquid crystal polymer, or polyimide. The magnetic metal powder 136 contains Fe and is composed of a magnetic metal material, such as an FeSi-based alloy, e.g., FeSiCr, an FeCo-based alloy, an Fe-based alloy, e.g., NiFe, or an amorphous alloy thereof. The magnetic metal powder 136 has an average particle size of, for example, about 0.1 μm or more and 5 μm or less (i.e., from about 0.1 μm to 5 μm). In a production process of the inductor component 1, the average particle size of the magnetic metal powder 136 can be calculated as a particle size (what is called "D50") corresponding to a 50% cumulative value in a particle size distribution determined by a laser diffraction/scattering method. The amount of the magnetic metal powder 136 contained is preferably about 20% or more by volume and about 70% or less by volume (i.e., from about 20% by volume to about 70% by volume) based on the entire magnetic layer. When the magnetic metal powder 136 has an average particle size of about 5 μm or less, the direct current superposition characteristics are further improved, and the use of the fine powder enables a reduction in iron loss at high frequencies. A magnetic powder composed of a NiZn- or MnZn-based ferrite may be used instead of the magnetic metal powder.

The first inductor device 2A and the second inductor device 2B include a first inductor line 21 and a second inductor line 22, respectively, disposed parallel to the first main surface 10*a* of the base body 10. Thus, the first inductor device 2A and the second inductor device 2B can be configured in a direction parallel to the first main surface 10*a* to enable a reduction in the profile of the inductor component 1. The first inductor line 21 and the second inductor line 22 are disposed on the same plane in the base body 10. Specifically, the first inductor line 21 and the second inductor line 22 are disposed only on the upper side of the insulating layer 61, i.e., the upper surface 61*b* of the insulating layer 61, and are covered with the second magnetic layer 12.

Each of the first and second inductor lines 21 and 22 is wound in a plane. Specifically, each of the first and second inductor lines 21 and 22 has a substantially semi-elliptical arc shape when viewed from the Z direction. That is, each of the first and second inductor lines 21 and 22 is a curved line wound about a half turn. Additionally, each of the first and second inductor lines 21 and 22 includes a straight portion in an intermediate section. In the present disclosure, the term "spiral" of each inductor line refers to a substantially curved shape including a substantially spiral shape wound in a plane and includes a substantially curved shape, such as the first inductor line 21 or the second inductor line 22, wound one turn or less. The substantially curved shape may partially include a substantially straight portion.

Each of the first and second inductor lines 21 and 22 preferably has a thickness of, for example, about 40 μm or more and about 120 μm or less (i.e., from about 40 μm to about 120 μm). In some embodiments, each of the first and second inductor lines 21 and 22 has a thickness of about 45 μm, a line width of about 40 μm, and a line spacing of about 10 μm. The line spacing is preferably about 3 μm or more and about 20 μm or less (i.e., from about 3 μm to about 20 μm) from the viewpoint of achieving good insulating properties.

Each of the first and second inductor lines 21 and 22 is composed of a conductive material and a low-electrical-resistance metal material, such as Cu, Ag, or Au. In this embodiment, the inductor component 1 includes only a single layer of the first and second inductor lines 21 and 22. This can achieve the low-profile inductor component 1. Each of the first and second inductor lines 21 and 22 may be formed of a metal film and may have a structure in which a conductive layer composed of, for example, Cu or Ag is disposed on an undercoat layer that is composed of, for example, Cu or Ti and that is deposited by electroless plating.

The first inductor line 21 has a first end portion and a second end portion that are electrically coupled to the first substantially columnar line 31 and the second substantially columnar line 32, respectively, located at outer side portions and is curved in an arc from the first substantially columnar line 31 and the second substantially columnar line 32 toward the center of the inductor component 1. The first inductor line 21 has pad portions having a larger line width than the substantially spiral shaped portion at both end portions thereof and is directly connected to the first and second substantially columnar lines 31 and 32 at the pad portions.

Similarly, the second inductor line 22 has a first end portion and a second end portion that are electrically coupled to the third substantially columnar line 33 and the fourth substantially columnar line 34, respectively, located at outer side portions and is curved in an arc from the third substantially columnar line 33 and the fourth substantially columnar line 34 toward the center of the inductor component 1.

Here, in each of the first and second inductor lines 21 and 22, a range surrounded by a curve of the first or second inductor line 21 or 22 and a straight line connecting both end portions of the first or second inductor line 21 or 22 is defined as an inside diameter portion. The inside diameter portions of the first and second inductor lines 21 and 22 do not overlap with each other, and the first and second inductor lines 21 and 22 are separated from each other, when viewed from the Z direction.

Lines extend in a direction parallel to the X direction from connection positions of the first and second inductor lines 21 and 22 and the first to fourth substantially columnar lines 31 to 34 and extend toward outer side portions of the inductor component 1. The lines are exposed at the outer side portions of the inductor component 1. That is, the first and second inductor lines 21 and 22 include exposed portions 200 each exposed to the outside at a side surface parallel to the stacking direction of the inductor component 1 (a plane parallel to the YZ plane).

The lines will be coupled to feeding lines when additional electroplating is performed after the formation of the shapes of the first and second inductor lines 21 and 22 in the production process of the inductor component 1. The use of the feeding lines enables easy implementation of additional electroplating in a state of an inductor substrate before the singulation of the inductor substrate into individual inductor components 1, thereby reducing the distance between the lines. The implementation of the additional electroplating can reduce the distance between the first and second inductor lines 21 and 22, thereby enhancing the magnetic coupling of the first and second inductor lines 21 and 22, increasing the line width of the first and second inductor lines 21 and 22 to reduce the electrical resistance, and reducing the size of the external form of the inductor component 1.

The first and second inductor lines 21 and 22 have the exposed portions 200 and thus can be highly resistant to electrostatic discharge damage during the processing of the inductor substrate. In each of the inductor lines 21 and 22, the thickness (a dimension in the Z direction) of the exposed surface 200*a* of each exposed portion 200 is preferably equal to or less than the thickness (a dimension in the Z direction) of the inductor lines 21 and 22 and about 45 μm or more. In the case where the thickness of the exposed surface 200*a* is equal to or less than the thickness of the inductor lines 21 and 22, the proportions of the magnetic layers 11 and 12 can be increased to improve the inductance. In the case where the thickness of the exposed surface 200*a* is about 45 μm or more, the occurrence of disconnection near the exposed surface 200*a* can be reduced. The exposed surface 200*a* is preferably formed of an oxide film. In this case, a short circuit can be suppressed between the inductor component 1 and its adjacent component.

The first to fourth substantially columnar lines 31 to 34 extend in the Z direction from the inductor lines 21 and 22 and penetrate through the second magnetic layer 12. The first substantially columnar line 31 extends upward from the upper surface of one end portion of the first inductor line 21. An end face of the first substantially columnar line 31 is exposed at the first main surface 10*a* of the base body 10. The second substantially columnar line 32 extends upward from the upper surface of the other end portion of the first inductor line 21. An end face of the second substantially columnar line 32 is exposed at the first main surface 10*a* of the base body 10. The third substantially columnar line 33 extends upward from the upper surface of one end portion of the second inductor line 22. An end face of the third substantially columnar line 33 is exposed at the first main surface 10*a* of the base body 10. The fourth substantially columnar line 34 extends upward from the upper surface of the other end portion of the second inductor line 22. An end face of the fourth substantially columnar line 34 is exposed at the first main surface 10*a* of the base body 10.

Accordingly, the first substantially columnar line 31, the second substantially columnar line 32, the third substantially columnar line 33, and the fourth substantially columnar line 34 extend linearly from the first inductor device 2A and the second inductor device 2B to the end faces exposed at the first main surface 10*a* in a direction perpendicular to the end faces. Thereby, the first external terminal 41, the second external terminal 42, the third external terminal 43, and the fourth external terminal 44 can be coupled to the first inductor device 2A and the second inductor device 2B at a shorter distance, thus enabling the inductor component 1 to have lower resistance and higher inductance. The first to fourth substantially columnar lines 31 to 34 are composed of a conductive material, such as the same material as that of the inductor lines 21 and 22.

The first to fourth external terminals 41 to 44 are disposed on the first main surface 10*a* of the base body 10. Each of the first to fourth external terminals 41 to 44 is formed of a metal film disposed on an outer surface of the second magnetic layer 12 (composite body). The first external terminal 41 is in contact with the end face of the first substantially columnar line 31 exposed at the first main surface 10*a* of the base body 10 and is electrically coupled to the first substantially columnar line 31. Thereby, the first external terminal 41 is electrically coupled to one end portion of the first inductor line 21. The second external terminal 42 is in contact with an end face of the second substantially columnar line 32 exposed at the first main surface 10*a* of the base body 10 and is electrically coupled to the second substantially columnar line 32. Thereby, the second external terminal 42 is electrically coupled to the other end portion of the first inductor line 21.

Similarly, the third external terminal 43 is in contact with the end face of the third substantially columnar line 33, is electrically coupled to the third substantially columnar line 33, and is electrically coupled to one end portion of the second inductor line 22. The fourth external terminal 44 is in contact with the end face of the fourth substantially columnar line 34, is electrically coupled to the fourth substantially columnar line 34, and is electrically coupled to the other end of the second inductor line 22.

The first main surface 10*a* of the inductor component 1 has a first end edge 101 and a second end edge 102 that extend linearly and that correspond to sides of a substantially rectangular shape. The first end edge 101 and the second end edge 102 are end edges of the first main surface 10*a* connected to a first side surface 10*b* and a second side surface 10*c*, respectively, of the base body 10. The first external terminal 41 and the third external terminal 43 are arranged along the first end edge 101 adjacent to the first side surface 10*b* of the base body 10. The second external terminal 42 and the fourth external terminal 44 are arranged along the second end edge 102 adjacent to the second side surface 10*c* of the base body 10. The first side surface 10*b* and the second side surface 10*c* of the base body 10 extend in the Y direction and coincide with the first end edge 101 and the second end edge 102, respectively, when viewed from a direction perpendicular to the first main surface 10*a* of the base body 10. The arrangement direction of the first external terminal 41 and the third external terminal 43 is a direction connecting the center of the first external terminal 41 and the center of the third external terminal 43. The arrangement direction of the second external terminal 42 and the fourth external terminal 44 is a direction connecting the center of the second external terminal 42 and the center of the fourth external terminal 44.

The insulating film 50 is disposed on a portion of the first main surface 10*a* of the base body 10 where the first to fourth external terminals 41 to 44 are not disposed. However, end portions of the first to fourth external terminals 41 to 44 may extend on portions of the insulating film 50, so that the portions of the insulating film 50 may overlap the end portions of the first to fourth external terminals 41 to 44 in the Z direction. The insulating film 50 is composed of, for example, a resin material, such as an acrylic resin, an epoxy-based resin, or polyimide, having high electrical insulating properties. This can lead to improved insulation among the first to fourth external terminals 41 to 44. The insulating film 50 serves as a mask used for the pattern formation of the first to fourth external terminals 41 to 44 to improve the production efficiency. When the magnetic metal powder 136 is exposed at a surface of the resin 135, the insulating film 50 can cover the exposed magnetic metal powder 136 to prevent the exposure of the magnetic metal powder 136 to the outside. The insulating film 50 may contain a filler composed of an insulating material, such as silica or barium sulfate.

As illustrated in FIG. 2, the first external terminal 41 is a multilayer metal film including two layers: a metal film 410 and a solderable layer 411. The metal film 410 is disposed on the second magnetic layer 12, in contact with the resin 135 and the magnetic metal powder 136, and covered with the solderable layer 411. The structures of the second, third, and fourth external terminals 42, 43, and 44 are the same as the structure of the first external terminal 41; thus, the first external terminal 41 alone will be described below.

The metal film 410 mainly contains Ni. The magnetic metal powder 136 contains Fe, and the metal film 410 mainly contains Ni; thus, the coefficient of linear expansion of the metal film 410 can be close to the coefficient of linear expansion of the magnetic metal powder 136, thereby suppressing a decrease in adhesion between the magnetic metal powder 136 and the metal film 410 under thermal loading. Specifically, Fe has a coefficient of linear expansion of 11.7 [$\times 10^{-6}$/K]. Ni has a coefficient of linear expansion of 13.3 [$\times 10^{-6}$/K]. Cu has a coefficient of linear expansion of 17.7[$\times 10^{-6}$/K]. Thus, the coefficient of linear expansion of the metal film containing Ni is closer to the coefficient of linear expansion of the magnetic metal powder containing Fe than the coefficient of linear expansion of a metal film containing Cu. The ionization tendency of Fe in the magnetic metal powder 136 is close to that of Ni in the metal film 410; thus, the substitution reaction between Fe and Ni is less likely to occur. This enables the suppression of a decrease in adhesion between the magnetic metal powder 136 and the metal film 410 due to the substitution reaction. Additionally, since the substitution reaction between Fe and Ni is less likely to occur, a decrease in the amount of the magnetic metal powder 136 can be suppressed to suppress the deterioration of the characteristics, such as an L value.

Accordingly, the reliability of the adhesion between the magnetic metal powder 136 and the metal film 410 can be improved, thereby providing the inductor component 1 in which the peeling of the external terminal is suppressed.

As described above, in the present disclosure, the ionization tendency of Fe in the magnetic metal powder is close to that of Ni in the metal film; thus, the substitution reaction between Fe and Ni is less likely to occur. In contrast, in the case where Fe is used for the magnetic metal powder and where Cu is used for the metal film as in the related art, the substitution reaction between Fe and Cu proceeds because the ionization tendency of Fe is remote from that of Cu. Accordingly, the idea of the present disclosure is completely different from that of the related art. In the related art, Cu in the metal film is formed by a substitution reaction with Fe in the magnetic metal powder. Thus, the substitution reaction results in a low adhesion between the magnetic metal powder and the metal film. Additionally, in the related art, the substitution reaction between Fe and Cu may result in a decrease in the amount of the magnetic metal powder to deteriorate the characteristics, such as an L value.

The metal film 410 is preferably formed by electroless plating treatment. In this case, the shape of the external terminals can be freely formed, compared with the case where the metal film 410 is formed by electroplating treatment.

The metal film 410 is preferably amorphous. In this case, the metal film 410 can have a flat surface and a small thickness, compared with the case where the metal film 410 has a crystal structure.

The metal film 410 preferably contains P. In this case, the metal film 410 has improved corrosion resistance. As will be described below, P originates from sodium hypophosphite serving as a reductant used in the formation of the metal film 410 by electroless plating treatment. The incorporation of P starts the precipitation of Ni without a substitution reaction with Fe. This can lead to further improved adhesion between the magnetic metal powder and the metal film.

The metal film 410 preferably has a P content of about 1% or more by weight and about 13% or less by weight (i.e., from about 1% by weight to about 13% by weight). In the case where the metal film 410 has a P content of about 1% or more by weight, the metal film 410 can reliably have improved corrosion resistance and improved adhesion. In the case where the metal film 410 has a P content of 13% or less by weight, a film to be formed into the metal film 410 grows satisfactorily during the film formation, so that the formability of the metal film 410 is improved.

In the case where the metal film 410 is formed by electroless plating treatment, for example, in the case where sodium hypophosphite is used as a reductant and where a base body (composite body) is immersed in a Ni plating solution, a layer of electroless Ni plating can be formed as a metal film. Sodium hypophosphite is active on Fe in the magnetic metal powder. Thus, Ni starts to precipitate without a substitution reaction with Fe. That is, the Ni layer is formed by autocatalytic reduction plating treatment. This can lead to a high adhesion between Ni and Fe. At this time, P is co-deposited in the metal film.

The metal film (external terminal) preferably contains Fe. In this case, the coefficient of linear expansion of the metal film can be closer to that of the magnetic metal powder, thereby further suppressing a decrease in adhesion between the magnetic metal powder and the metal film under thermal loading. To incorporate Fe into the metal film, for example, the metal film is formed by plating treatment with a plating solution containing Fe. This makes it difficult for the magnetic metal powder to dissolve in the plating solution, thus enabling the suppression of a decrease in the amount of the magnetic metal powder.

The solderable layer 411 covers the metal film 410 and serves as the outermost layer of the first external terminal 41. The solderable layer 411 contains a material having high wettability, such as Au or Sn. An external terminal of the related art has a three-layer structure of a highly conductive Cu or Ag layer as a lowermost layer, a metal film, such as a Ni layer, disposed thereon, and a solderable layer composed of, for example, Au or Sn. In contrast, the first external terminal 41 has the two-layer structure of the metal film 410 and the solderable layer 411 as described above. This enables the external terminal to have a smaller thickness and a lower electrical resistance.

Production Method

A method for producing the inductor component 1 will be described below.

Figure 3A:
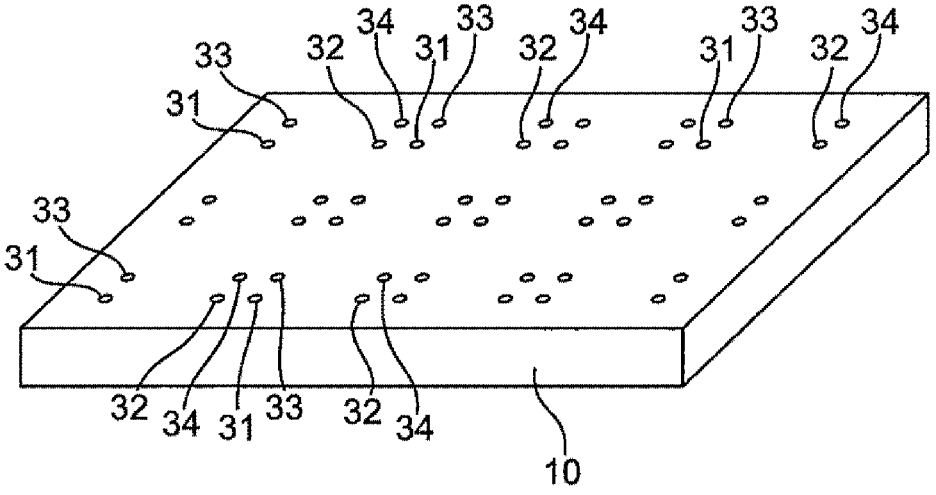
FIG. 3A is an explanatory view of a method for producing an inductor component.
Figure 3B:
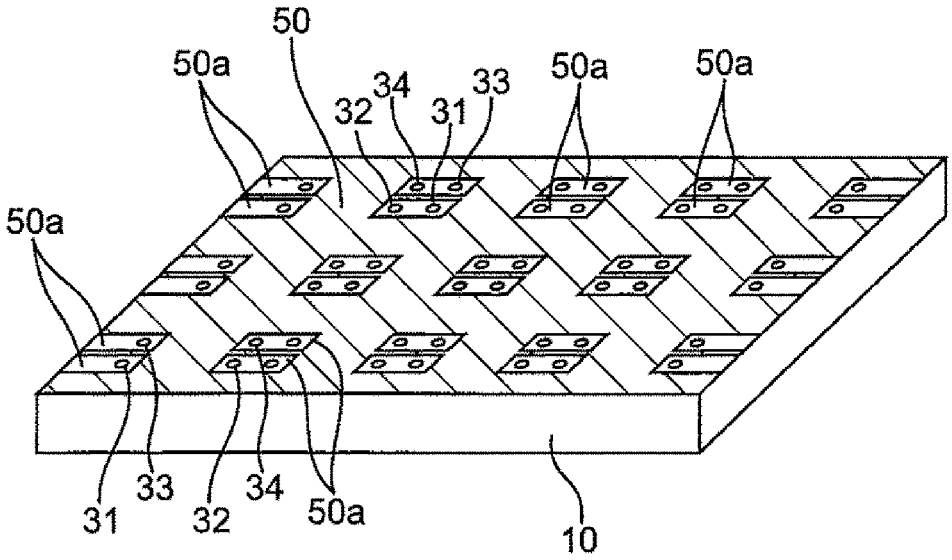
FIG. 3B is an explanatory view of the method for producing an inductor component.

As illustrated in FIG. 3A, the upper surface of the base body 10 is subjected to grinding processing such as grinding in a state in which the multiple inductor lines 21 and 22 and the multiple substantially columnar lines 31 to 34 are covered with the base body 10. Thereby, the end faces of the substantially columnar lines 31 to 34 are exposed at the upper surface of the base body 10. As illustrated in FIG. 3B, the insulating film 50 represented by a hatch pattern is then formed on the entire upper surface of the base body 10 by, for example, a coating method such as spin coating or screen printing, or a dry process such as the lamination of a dry film resist. The insulating film 50 is formed of, for example, a photosensitive resist.

Portions of the insulating film 50 in regions where external terminals are to be formed are removed by, for example, photolithography, laser processing, drilling, or blasting, so that through-holes 50*a* at which end faces of the substantially columnar lines 31 to 34 and part of the base body 10 (second magnetic layer 12) are exposed are formed in the insulating film 50. At this time, as illustrated in FIG. 3B, an end face of each of the substantially columnar lines 31 to 34 may be entirely or partially exposed at a corresponding one of the through-holes 50*a*. The end faces of the multiple substantially columnar lines 31 to 34 may be exposed at one of the through-holes 50*a*.

Figure 3C:
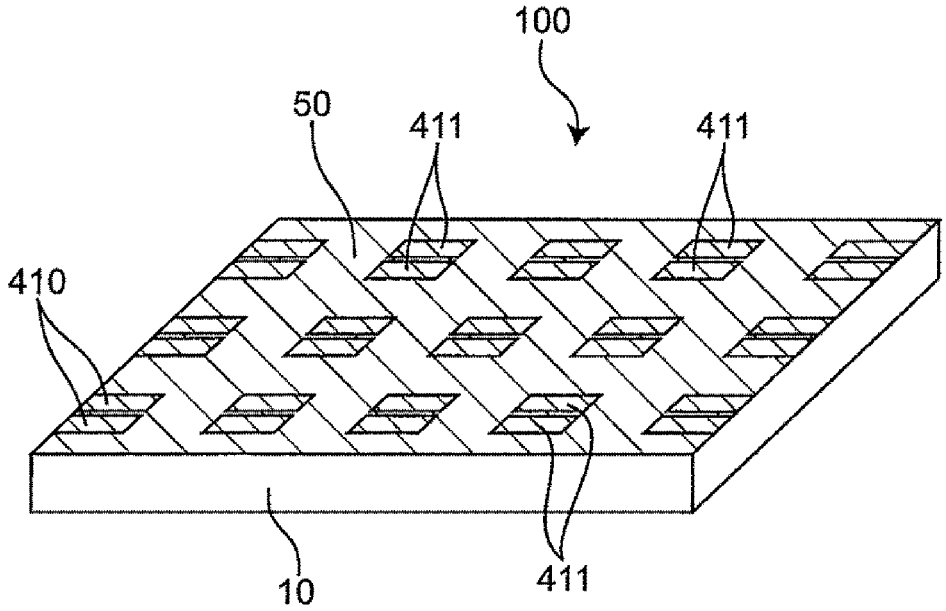
FIG. 3C is an explanatory view of the method for producing an inductor component.
Figure 3D:
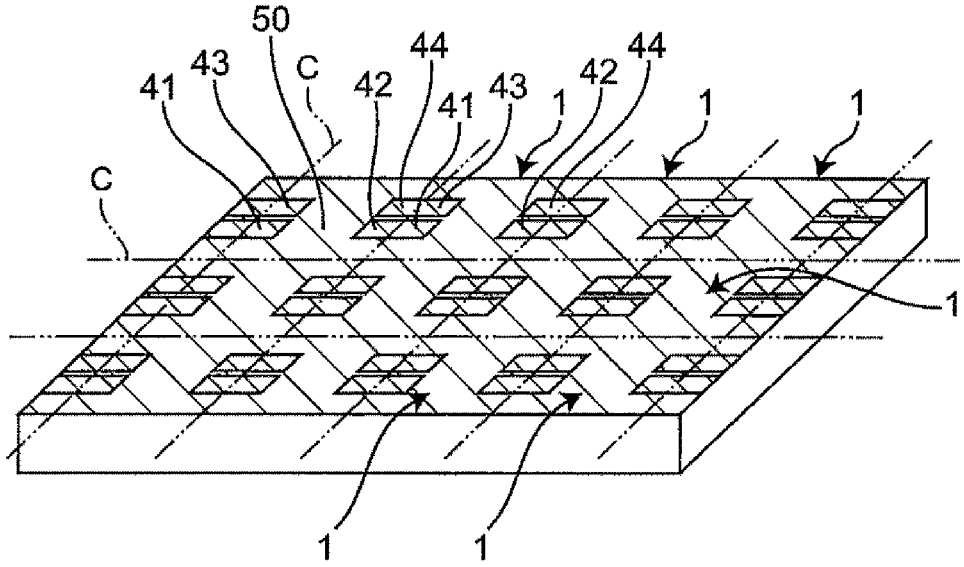
FIG. 3D is an explanatory view of the method for producing an inductor component.

As illustrated in FIG. 3C, the metal films 410 are formed in the through-holes 50*a* by a method described below, and then the solderable layers 411 represented by a hatch pattern are formed on the metal films 410 to form a mother substrate 100. The metal films 410 and the solderable layers 411 constitute the external terminals 41 to 44 before cutting. As illustrated in FIG. 3D, the mother substrate 100, i.e., the sealed multiple inductor lines 21 and 22, is then cut along cut lines C with, for example, a dicing blade into pieces each including the two inductor lines 21 and 22, thereby producing the multiple inductor components 1. The metal films 410 and the solderable layers 411 are cut along cut lines C to form the external terminals 41 to 44. A method for producing the external terminals 41 to 44 may be a method in which the metal films 410 and the solderable layers 411 are cut as described above or may be a method in which the insulating film 50 is removed in advance in such a manner that the through-holes 50*a* have the shape of the external terminals 41 to 44, and then the metal films 410 and the solderable layers 411 are formed.

Method for Producing Metal Film 410

A method for producing the metal films 410 will be described below.

As described above, the end faces of the substantially columnar lines 31 to 34 and the base body 10 are exposed at the through-holes 50*a* when the through-holes 50*a* are formed in the insulating film 50. The end faces of the substantially columnar lines 31 to 34 and the upper surface of the base body 10 exposed at the through-holes 50*a* are subjected to electroless plating treatment to form Ni layers each serving as the metal film 410 that is in contact with the base body 10 and that is electrically conductive.

Specifically, each metal film 410 mainly containing Ni is deposited on the magnetic metal powder 136 containing Fe by autocatalytic reduction plating treatment. For example, the base body 10 is immersed in a Ni plating solution containing sodium hypophosphite serving as a reductant to form layers of electroless Ni plating as the metal films 410 on the second magnetic layer 12 (composite body). The metal films 410 are in contact with the resin 135 and the magnetic metal powder 136 in the second magnetic layer 12.

To form the metal films 410 on the substantially columnar (Cu) lines 31 to 34, for example, the metal films 410 deposited on the magnetic metal powder 136 may be allowed to grow to extend over the substantially columnar lines 31 to 34. Alternatively, Pd layers may be formed as catalyst layers on the substantially columnar lines 31 to 34, and then the metal films 410 may be formed on the Pd layers by electroless plating treatment.

The present disclosure is not limited to the foregoing embodiment, and can be changed in design without departing from the scope of the present disclosure.

In the foregoing embodiment, two inductor devices, i.e., the first inductor device and the second inductor device, are arranged in the base body. However, three or more inductor devices may be arranged. In this case, six or more external terminals and six or more substantially columnar lines are arranged.

In the foregoing embodiment, the number of turns of the inductor line of each of the inductor devices is less than about one. However, the inductor line may be a curved line in which the number of turns of the inductor line is more than about one. The number of layers of the inductor lines in the inductor device is not limited to one, and a multilayer structure including two or more layers may be used. The arrangement of the first inductor line of the first inductor device and the second inductor line of the second inductor device is not limited to the configuration in which the first and second inductor lines are arranged on the same plane parallel to the first main surface and may be a configuration in which the first and second inductor lines are arranged in a direction perpendicular to the first main surface.

The "inductor line" produces magnetic flux at the magnetic layer when a current flows, thereby imparting inductance to the inductor component. The structure, shape, material, and so forth thereof are not particularly limited. For example, various known shaped lines, such as meander-shaped lines, may be used.

In the foregoing embodiment, the metal films are used as the external terminals of the inductor component. However, the metal films are not limited thereto. For example, the metal films may be used as internal electrodes of the inductor component. Additionally, the use of the metal films is not limited to the inductor component. The metal films may be used for other electronic components, such as capacitor components and resistor components, and may be used for circuit boards incorporating these electronic components. For example, the metal films may be used as line patterns of circuit boards.

In the foregoing embodiment, the metal films are used for the external terminals. However, the metal films may be used for the inductor lines. Specifically, the metal films may be formed on the composite body in place of a substrate by electroless plating treatment to form inductor lines. In this case, the metal films having the above-described effects can be obtained as the inductor lines, and the metal films can be formed so as to have the effects.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component, comprising:

a composite body composed of a composite material of a resin and a magnetic metal powder; and a metal film disposed on an outer surface of the composite body, the magnetic metal powder containing Fe, the metal film mainly containing Ni, and further containing at least one of P or Fe, and being in contact with the resin and the magnetic metal powder.

2. The electronic component according to claim 1, wherein the metal film is amorphous.

3. The electronic component according to claim 2, wherein the metal film further contains Fe.

4. The electronic component according to claim 2, wherein the metal film further contains P.

5. The electronic component according to claim 4, wherein the metal film further contains Fe.

6. The electronic component according to claim 4, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a solderable layer covering the metal film, wherein the metal film is in contact with the substantially columnar line, and the metal film and the solderable layer are included in an external terminal.

7. The electronic component according to claim 4, wherein the metal film has a P content of from about 1% by weight to about 13% by weight.

8. The electronic component according to claim 7, wherein the metal film further contains Fe.

9. The electronic component according to claim 7, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a solderable layer covering the metal film, wherein the metal film is in contact with the substantially columnar line, and the metal film and the solderable layer are included in an external terminal.

10. The electronic component according to claim 2, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a solderable layer covering the metal film, wherein the metal film is in contact with the substantially columnar line, and the metal film and the solderable layer are included in an external terminal.

11. The electronic component according to claim 1, wherein the metal film further contains P.

12. The electronic component according to claim 11, wherein the metal film further contains Fe.

13. The electronic component according to claim 11, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a solderable layer covering the metal film, wherein the metal film is in contact with the substantially columnar line, and the metal film and the solderable layer are included in an external terminal.

14. The electronic component according to claim 11, wherein the metal film has a P content of from about 1% by weight to about 13% by weight.

15. The electronic component according to claim 14, wherein the metal film further contains Fe.

16. The electronic component according to claim 14, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a solderable layer covering the metal film, wherein the metal film is in contact with the substantially columnar line, and the metal film and the solderable layer are included in an external terminal.

17. The electronic component according to claim 1, wherein the metal film further contains Fe.

18. The electronic component according to claim 17, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a solderable layer covering the metal film, wherein the metal film is in contact with the substantially columnar line, and the metal film and the solderable layer are included in an external terminal.

19. The electronic component according to claim 1, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a solderable layer covering the metal film, wherein the metal film is in contact with the substantially columnar line, and the metal film and the solderable layer are included in an external terminal.

20. A method for producing the electronic component according to claim 1, the method comprising:

forming the metal film on an outer surface of the composite body by electroless plating treatment; and depositing the metal film on the magnetic metal powder by autocatalytic reduction plating treatment so that the metal film is in contact with the resin.

* * * * *